US010384464B2

(12) United States Patent
Uemura et al.

(10) Patent No.: US 10,384,464 B2
(45) Date of Patent: Aug. 20, 2019

(54) OPTICAL PRINT HEAD AND IMAGE FORMING DEVICE

(71) Applicant: Konica Minolta, Inc., Tokyo (JP)

(72) Inventors: Takaki Uemura, Seto (JP); Makoto Obayashi, Toyokawa (JP); Masayuki Iijima, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/724,868

(22) Filed: Oct. 4, 2017

(65) Prior Publication Data

US 2018/0104964 A1 Apr. 19, 2018

(30) Foreign Application Priority Data

Oct. 13, 2016 (JP) ..... 2016-201945

(51) Int. Cl.
*B41J 2/45* (2006.01)

(52) U.S. Cl.
CPC ..... *B41J 2/451* (2013.01)

(58) Field of Classification Search
CPC ..... B41J 2/44; B41J 2/442; B41J 2/445; B41J 2/447; B41J 2/4473; B41J 2/45; B41J 2/451; B41J 2/455; B41J 2/46; B41J 2/465; B41J 2/4655; B41J 2/47; B41J 2/471; B41J 2/473
See application file for complete search history.

(56) References Cited

U.S. PATENT DOCUMENTS 4,998,118 A * 3/1991 Ng ..... B41J 2/451 347/236
6,208,366 B1 * 3/2001 Aoyama ..... B41J 2/451 347/234

FOREIGN PATENT DOCUMENTS

JP 2005144686 A 6/2005
JP 2008155458 A * 7/2008
JP 2008155458 A 7/2008

OTHER PUBLICATIONS

Hachisuga, MachineTranslation of JP-2008155458-A, 2008 (Year: 2008).*

* cited by examiner

*Primary Examiner* — Scott A Richmond
(74) *Attorney, Agent, or Firm* — Lucas & Mercanti, LLP

(57) ABSTRACT

An optical print head including a light emitting member, an optical member, a detection unit, and a correction unit. The light emitting member is elongated in a longitudinal direction with light emitting elements arranged along the longitudinal direction. The optical member is elongated in the longitudinal direction with optical elements arranged along the longitudinal direction, the optical elements collecting light emitted by the light emitting elements. The detection unit detects an index value of linear expansion difference in the longitudinal direction of the light emitting member and the optical member. The correction unit uses the index value to correct an emitted light amount for each of the light emitting elements in order to offset differences in light collection efficiency caused by the linear expansion difference.

12 Claims, 12 Drawing Sheets

Position range 711

Temperature property

Position range 712

Temperature property

FIG. 10A

Lens correction value table 1000

| | | Detected light amount | | | |
|---|---|---|---|---|---|
| | | Pa | Pb | ··· | Pz |
| Element number | OLED #1 | LCa1 | LCb1 | ··· | LCz1 |
| | OLED #2 | LCa2 | LCb2 | ··· | LCz2 |
| | ··· | ··· | ··· | ··· | ··· |
| | OLED #15000 | LCa15000 | LCb15000 | ··· | LCz15000 |

FIG. 10B

Element correction value table 1010

Ambient temperature = 80°C

Ambient temperature = 10°C

Ambient temperature = 0°C

| | | Cumulative light emission time (h) | | | |
|---|---|---|---|---|---|
| | | 50 | 100 | ··· | 1000 |
| Light amount | La | Cla50 | Cla100 | ··· | Cla1000 |
| | Lb | Clb50 | Clb100 | ··· | Clb1000 |
| | Lc | Clc50 | Clc100 | ··· | Clc1000 |
| | Ld | Cld50 | Cld100 | ··· | Cld1000 |

OPTICAL PRINT HEAD AND IMAGE FORMING DEVICE

CROSS-REFERENCE TO RELATED APPLICATIONS

This application is based on and claims the priority of Japanese Patent Application No. 2016-201945 filed on Oct. 13, 2016, filed in Japan, the contents of which are hereby incorporated by reference.

BACKGROUND

Technical Field

The present invention relates to optical writing devices and image forming devices, and in particular to techniques for preventing unevenness in light amounts due to a change in ambient temperature in the case of use of organic light emitting diodes (OLED).

Related Art

In recent years, in order to reduce size and cost of image forming devices, development of line optical writing devices that use OLEDs as light-emitting elements, also known as OLED print heads (OLED-PH), has been advanced. An OLED-PH has OLEDs and thin film transistors (TFT) formed on the same substrate, allowing for a reduction in manufacturing cost.

An OLED-PH includes a rod-lens array for collecting light emitted by OLEDs when optical writing is performed onto an outer circumferential surface of a photoreceptor drum. The rod-lens array is an optical element in which a large number of rod lenses are arrayed, and light collection efficiency for light emitted from an OLED differs depending on position of the OLED relative to a rod lens. Thus, by increasing or decreasing an amount of emitted light according to light collection efficiency between OLEDs, exposure amount on the outer circumferential surface of the photoreceptor drum is made uniform.

However, the OLED-PH is exposed to a high temperature when OLEDs are formed, and therefore a glass material that has a very small linear expansion coefficient is used for a glass substrate on which the OLEDs are mounted. On the other hand, the rod-lens array uses resin, integrating a large number of rod lenses, and has a larger linear expansion coefficient than the glass substrate on which the OLEDs are mounted. Thus, when ambient temperature varies, positions of the OLEDs on the glass substrate and the rod lenses relative to each other change, changing light collection efficiency, and therefore unevenness in light amounts occurs.

As an example of a response to such problems, an optical print head including a lens correction value changing unit that changes a lens correction value based on environmental conditions, the lens correction value being for correcting light unevenness of light emitting elements in a lens unit, has been proposed in JP 2008-155458. In this way, even if positions of the OLEDs and rod lenses relative to each other change, and light collection efficiency varies due to changes in ambient temperature, lens correction values are changed based on environmental conditions, and therefore unevenness in light amounts on the circumferential surface of the photoreceptor drum can be prevented.

SUMMARY OF THE INVENTION

However, according to the prior art above, environmental conditions are specifically detected values of ambient temperature, and the lens correction value is changed according to estimates of positions of OLEDs and rod lenses relative to each other made from detected temperatures. Thus, it is not possible to avoid unevenness in light amounts due to errors in estimation of relative positions.

Further, positions of the OLEDs and the rod lenses relative to each other can also vary due to factors other than ambient temperature, such as humidity. However, the prior art cannot prevent unevenness in light amounts due to a reason other than ambient temperature. Further, if an attempt is made to prevent unevenness in light amounts due to a reason other than ambient temperature, various problems occur such as processing for changing a lens correction value becoming complex and storage being insufficient for the increase in data required for the change.

The present invention has been achieved in view of problems such as the problems described above, and an aim of the present invention is to provide an optical print head and image forming device that can accurately correct light unevenness caused by changes in environmental conditions.

In order to achieve the above aim, an optical print head pertaining to the present invention is an optical print head comprising: a light emitting member elongated in a longitudinal direction with light emitting elements arranged along the longitudinal direction; an optical member elongated in the longitudinal direction with optical elements arranged along the longitudinal direction, the optical elements collecting light emitted by the light emitting elements; a detection unit that detects an index value of linear expansion difference in the longitudinal direction of the light emitting member and the optical member; and a correction unit that uses the index value to correct an emitted light amount for each of the light emitting elements in order to offset differences in light collection efficiency caused by the linear expansion difference.

BRIEF DESCRIPTION OF THE DRAWINGS

These and other objects, advantages and features of the invention will become apparent from the following description thereof taken in conjunction with the accompanying drawings those illustrate a specific embodiments of the invention. In the drawings:

FIG. 10A shows example lens correction value table 1000, and FIG. 10B shows an example element correction value table 1010;

DESCRIPTION OF EMBODIMENTS

The following describes an optical print head and an image forming device according to an embodiment of the present invention, with reference to the drawings.

[1] Embodiment 1

An optical print head pertaining to Embodiment 1 of the present invention corrects light quantity unevenness by detecting an amount of light after collection via a rod-lens array of light emitted by an OLED.

(1-1) Configuration of Image Forming Device

First, a configuration of an image forming device pertaining to the present embodiment is described below.

Figure 1:
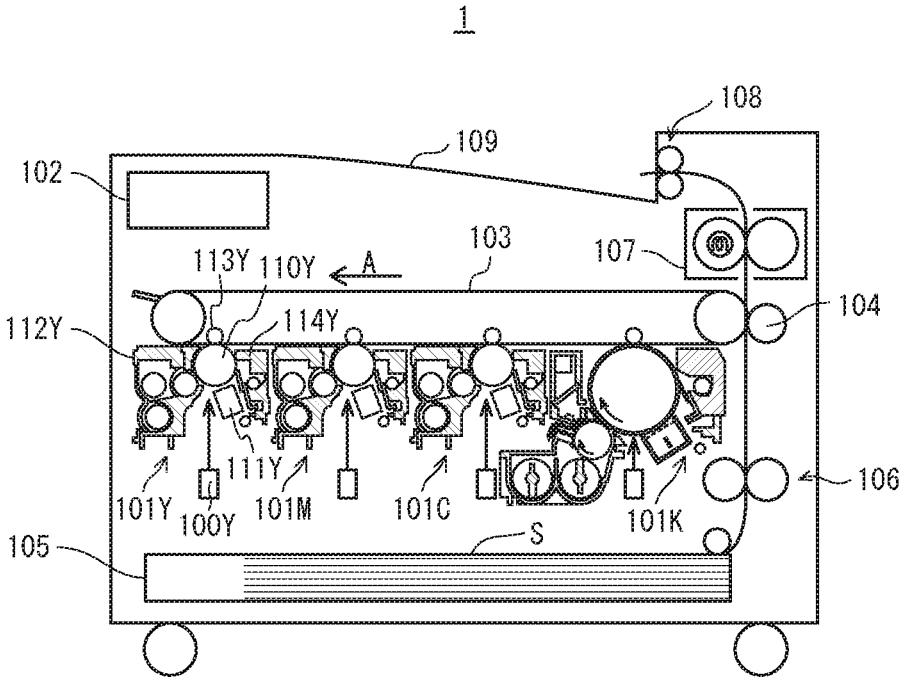
FIG. 1 shows major components of an image forming device pertaining to Embodiment 1 of the present invention.

As shown in FIG. 1, an image forming device 1 is a tandem-type color printer that includes image forming stations 101Y, 101M, 101C, and 101K, which form yellow (Y), magenta (M), cyan (C), and black (K) toner images, respectively. The image forming station 101Y uniformly charges an outer circumferential surface of a photoreceptor drum 110Y by a charging device 111Y, and an optical print head 100Y is an OLED-PH and forms an electrostatic latent image by optical writing.

A developer device 112Y supplies Y toner and develops an electrostatic latent image, and a primary transfer roller 113Y electrostatically transfers a Y toner image on the outer circumferential surface of the photoreceptor drum 110Y onto an intermediate transfer belt 103. Subsequently, a cleaning device 114Y cleans off toner remaining on the outer circumferential surface of the photoreceptor drum 110Y and removes residual charge. The image forming stations 101M, 101C, and 101K are configured similarly, and form M, C, and K toner images, respectively, according to similar operations. Y, M, C, K toner images are electrostatically transferred, in order, so as to overlap on the intermediate transfer belt 103 and form a color toner image. The intermediate transfer belt 103 is an endless belt that transports a color toner image to a secondary transfer roller pair 104 while rotating in the direction of an arrow A.

Recording sheets S are stored in a paper cassette 105. The recording sheets S are fed one sheet at a time, corresponding to color toner image formation, with transport timing being adjusted at a timing roller 106, to a secondary transfer roller pair 104, where a color toner image is electrostatically transferred. Subsequently, the color toner image is heat-fixed to the recording sheet S at a fixing device 107, and the recording sheet is discharged to a discharge tray 109 by a discharge roller pair 108.

A controller 102 controls the image formation operation described above.

Further, according to the present embodiment, operating environment conditions of the image forming device 1 and the optical print head 100 are in a range of temperature from 10 degrees Celsius to 35 degrees Celsius and humidity from 15% to 85%.

(1-2) Optical Print Head 100

The following is a description of configuration of the optical print head 100.

Figure 2:
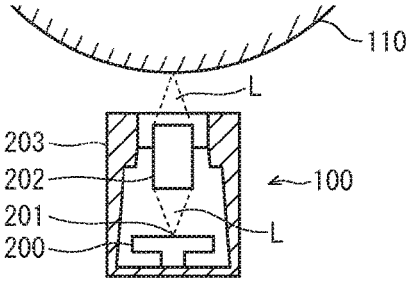
FIG. 2 shows major components of optical print head 100.

As shown in FIG. 2, the optical print head 100 includes an OLED panel 200 and a rod-lens array 202 (SELFOC lens array (SLA), where SELFOC is a registered trademark of Nippon Sheet Glass Co., Ltd.) housed in a housing 203. On the OLED panel 200 are 15,000 light exposure OLEDs 201 mounted along a main scanning direction. The light exposure OLEDs 201 each emit a light beam L.

The light exposure OLEDs 201 are current-driven light-emitting elements, and the higher the drive current for a given element, the more light emitted. The light exposure OLEDs 201 may be arranged in a line, and may be in a staggered arrangement. Light beams L emitted by the exposure OLEDs 201 are collected by the rod-lens array 202 and irradiate the outer circumferential surface of the photoreceptor drum 110. The housing 203 is a cover for preventing unwanted material entering the rod-lens array 202 and the OLED panel 200.

Cables and the like for connecting the optical print head 100 and other devices in the image forming device 1 are not shown in the drawings.

Figure 3:
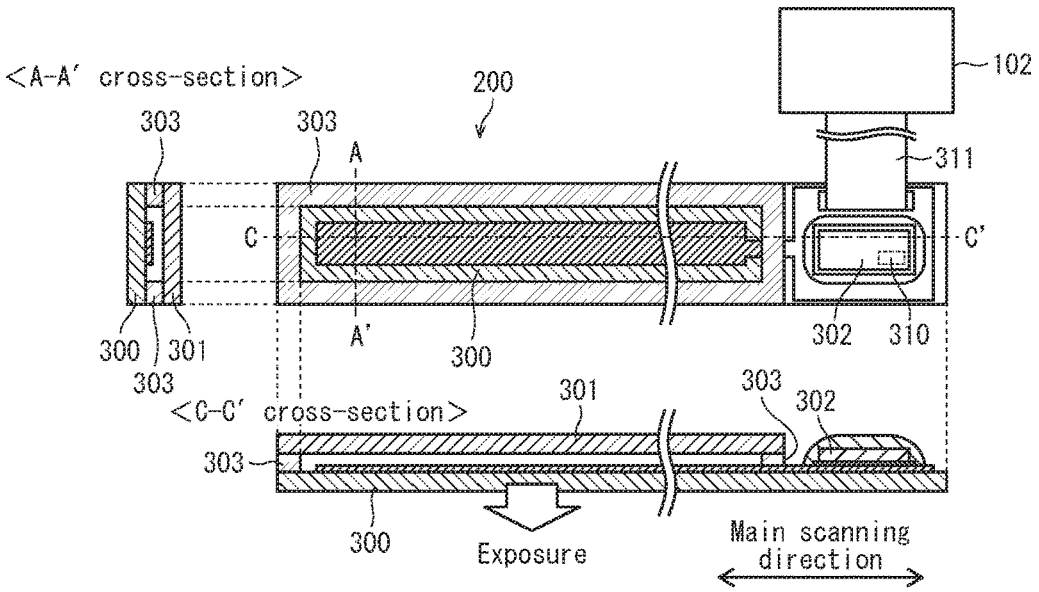
FIG. 3 shows major components of OLED panel 200.

As shown in FIG. 3, the OLED panel 200 includes a TFT substrate 300. The exposure OLEDs 201 are mounted on the TFT substrate 300, and a mounting region of the exposure OLEDs 201 is surrounded by a spacer frame 303, to which a sealing plate 301 is attached, thereby sealing the mounting region. A source integrated circuit (IC) 302 is mounted on the TFT substrate outside the sealed region. The source IC 302 includes a temperature sensor 310 that detects ambient temperature of the exposure OLEDs 201.

The controller 102 inputs image data to the source IC 302 via a flexible wire 311. The source IC 302 includes a digital to analogue converter (DAC) that converts image data to generate a DAC signal for each of the exposure OLEDs 201. The exposure OLEDs 201 each emit an amount of light according to a corresponding DAC signal.

Figure 4:
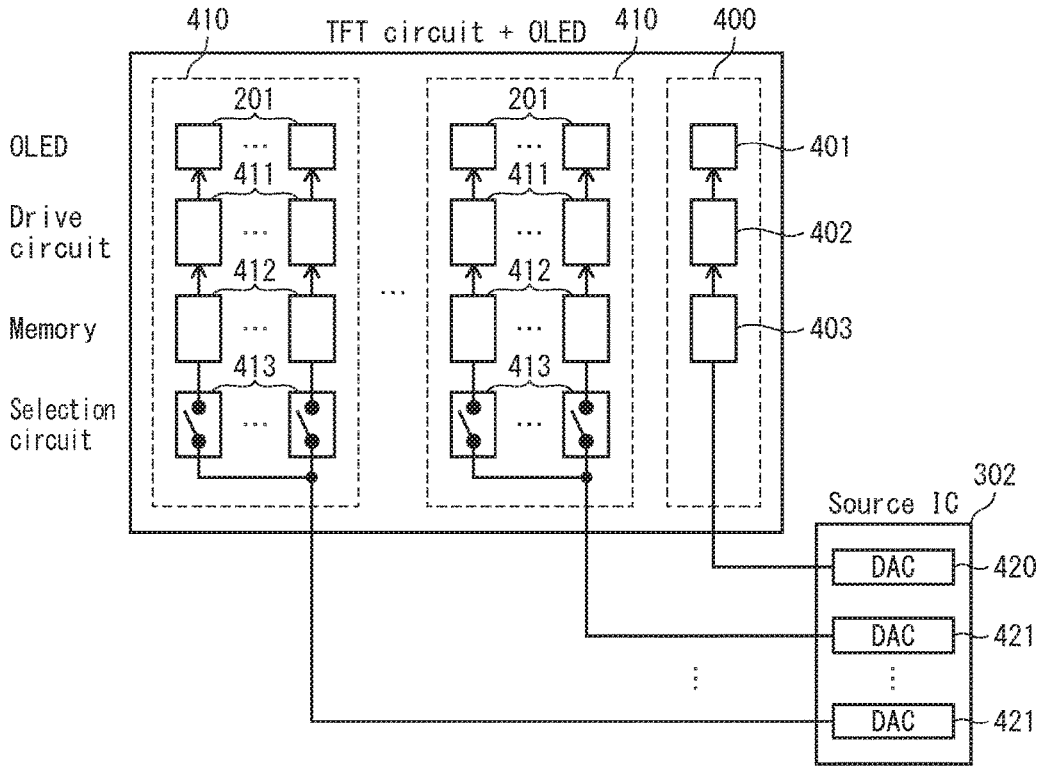
FIG. 4 is a block diagram showing configuration for light emission control for each OLED 201.

As shown in FIG. 4, the 15,000 exposure OLEDs 201 are divided into 150 light emission blocks 410 of 100 exposure OLEDs 201 each. Each of the light emission blocks 410 is provided with a drive circuit 411, a memory 412, and a selection circuit 413 for each of the exposure OLEDs 201.

The selection circuit 413 turns on and off an input path for a DAC signal from an exposure DAC 421 to the memory 412. The memory 412 stores a DAC signal outputted by the exposure DAC 421. The drive circuit 411 supplies a drive current according to the DAC signal stored in the memory 412 to the corresponding one of the exposure OLEDs 201, causing it to emit light.

Figure 5:
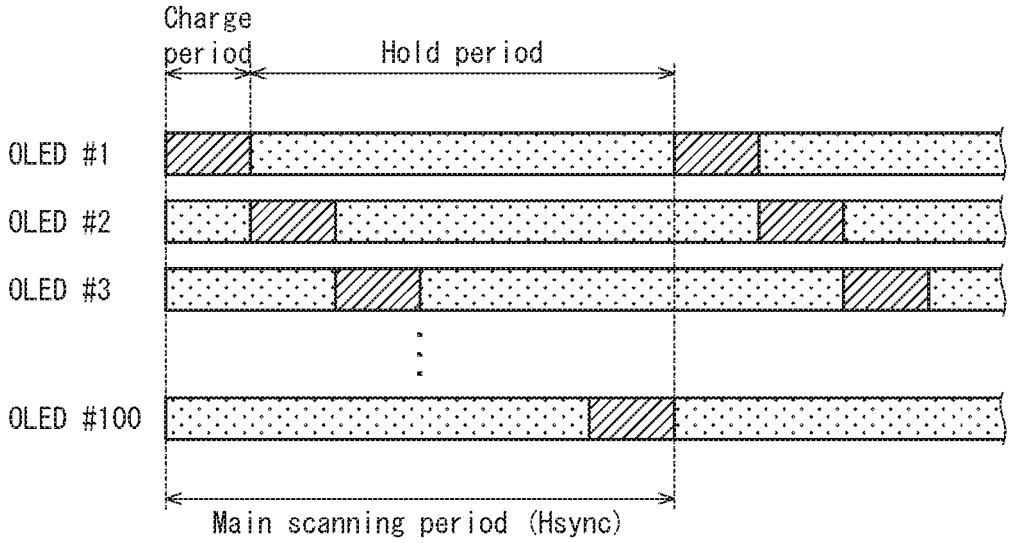
FIG. 5 is a timing chart for describing rolling drive of OLED panel 200.

For the 100 selection circuits 413 for one light emission block 410, sequential on/off control is performed for each main scanning period. This is referred to as rolling drive. As shown in FIG. 5, for each main scanning period, there is a charge period in which the selection circuit is on and a hold period in which the selection circuit 413 is off. In the charge period the DAC signal is inputted to the memory 412, and in the hold period the inputted DAC signal is held in the memory 412.

The charge periods for the 100 selection circuits 413 in one light emission block 410 are controlled so that they do not overlap each other, and therefore amount of light emission can be controlled for each of the exposure OLEDs 201. Further, if the number of the exposure OLEDs 201 in the optical print head 100 is increased to cope with high resolution, and an individual exposure DAC 421 is provided for each dot, the source IC 302 becomes large in scale and system cost increases. By adopting rolling drive, DAC can be shared between exposure OLEDs 201, and therefore increases in system cost can be suppressed.

The OLED panel 200 includes a detection OLED 402 that is separate from the exposure OLEDs 201. The detection OLED 401 is an OLED used for performing light amount correction of the exposure OLEDs 201. A drive circuit 402 and a memory 403 are connected to the detection OLED 401. A DAC signal outputted from a detection DAC 420 of the source IC 302 is stored in the memory 403, and drive current is supplied to the drive circuit 402 in accordance with the stored DAC signal, the detection OLED 401 thereby emitting light.

(1-3) Light Amount Detection

The following is a description of detection of light amount after collection, according to the detection OLED 401 and the rod-lens array 202.

Figure 6:
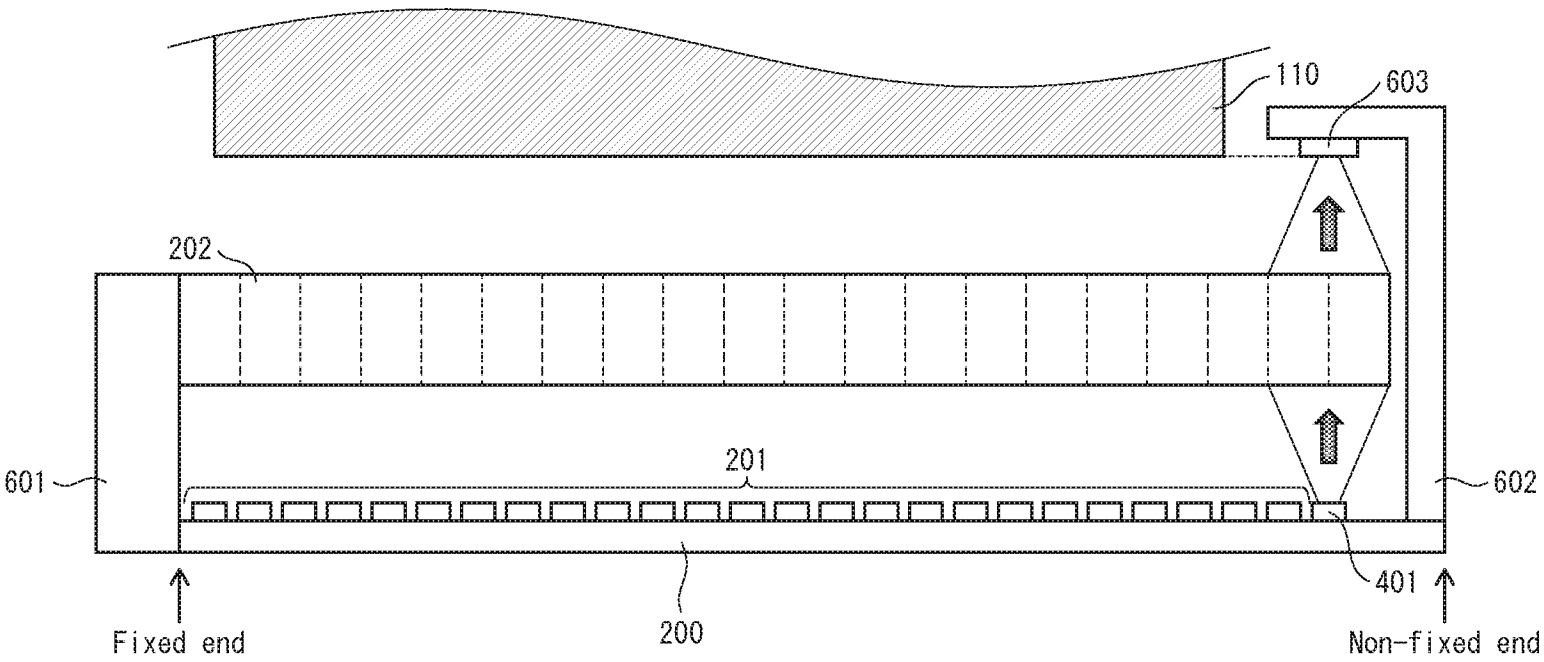
FIG. 6 shows a configuration for detecting position shift between exposure OLEDs 201 and rod-lens array 202.

The optical print head 100 is elongated in the main scanning direction, and the OLED panel 200 and the rod-lens array 202 are also elongated in the main scanning direction. As shown in FIG. 6, the OLED panel 200 and the rod-lens array 202 are fixed to a support member 601 at one end in the longitudinal direction. Hereinafter, the end of the OLED panel 200 fixed to the support member 601 is referred to as a "fixed end".

The exposure OLEDs 201 are arranged along the longitudinal direction on the main surface of the OLED panel 200. Further, the detection OLED 401 is disposed next to an end of the sequence of exposure OLEDs 201 that is farthest from the support member 601 in the longitudinal direction.

A sensor holding member 602 is fixed to an end (hereinafter, "non-fixed end") of the OLED panel 200 opposite the fixed end. At the other end of the sensor holding member 602, a light receiving element 603 is fixed at a position facing the detection OLED 401. A light receiving surface of the light receiving element 603 has the same height relative to the OLED panel 200 and the rod-lens array 202 as the outer circumferential surface of the photoreceptor drum 110.

Thus, in the same way as light emitted from the exposure OLEDs 201 is collected by the rod-lens array 202, light emitted from the detection OLED 401 is collected by the rod-lens array 202 and is incident on the light receiving element 603. The light receiving element 603 detects an amount of incident light.

In the longitudinal direction, distance from the non-fixed end to the OLED 401 and distance from the non-fixed end to the light receiving element 603 are both short, and therefore these distances hardly change even when ambient temperature changes. Thus, such change in distance is negligible compared to expansion and contraction of the rod-lens array 202 caused by changes in ambient temperature.

When ambient temperature changes, for example, and positions of the detection OLED 401 and a rod-lens relative to each other change due to a difference in linear expansion between the OLED panel 200 and the rod-lens array 202, light collection efficiency by the rod-lens of light emitted by the detection OLED 401 varies. Thus, a detected light amount P0 detected by the light receiving element 603 also varies according to the positions of the detection OLED 401 and the rod lens relative to each other.

Figure 7:
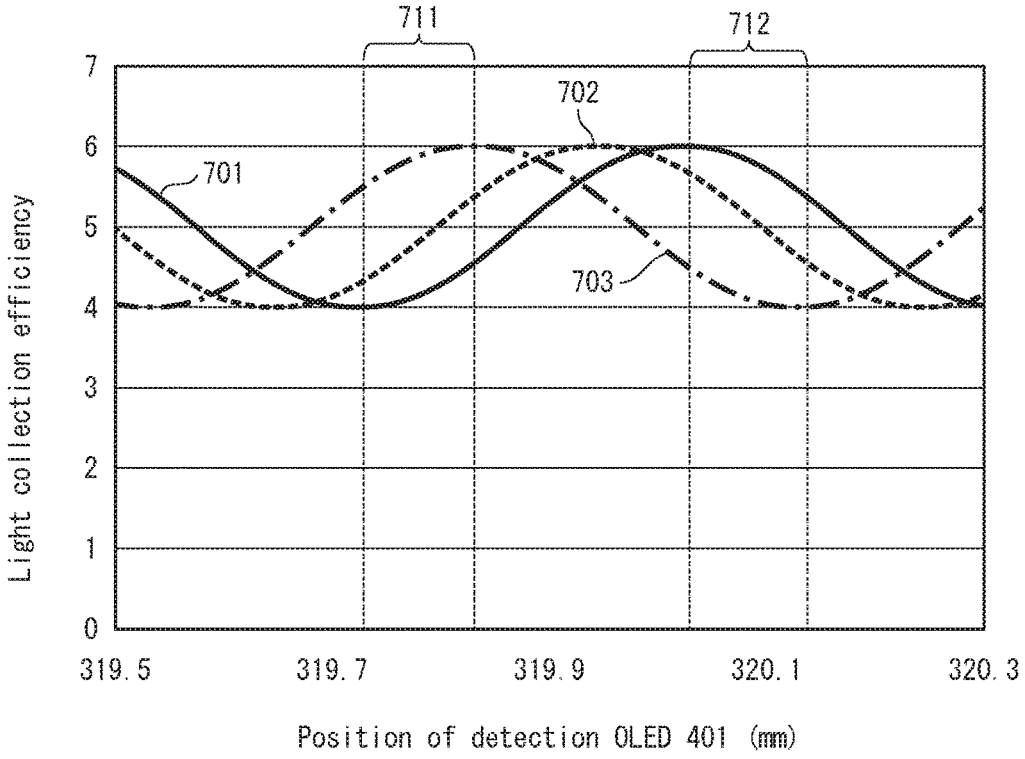
FIG. 7 is a graph showing a relationship between light collection efficiency and distance from a fixed end of OLED panel 200 to detection OLED 401.

FIG. 7 is a graph showing a relationship between light collection efficiency and distance from the fixed end of the OLED panel 200 to the detection OLED 401. The OLED panel 200 uses a glass plate having a very small linear expansion coefficient that hardly expands or contracts even when ambient temperature changes, and therefore position of the detection OLED 401 is substantially constant regardless of ambient temperature. Thus, collection efficiency varies exclusively due to expansion and contraction of the rod-lens array 202.

An unbroken line 701 represents light collection efficiency at an ambient temperature of 10 degrees Celsius, and a dashed line 702 represents light collection efficiency at an ambient temperature of 25 degrees Celsius. A dot-dash line 703 represents light collection efficiency at an ambient temperature of 50 degrees Celsius. As described above, the operating environment temperature of the image forming device 1 is a range from 10 degrees Celsius to 35 degree Celsius, which is included in the range from 10 degrees Celsius to 50 degrees Celsius shown in FIG. 7.

In a case in which the detection OLED 401 is disposed in a range 711 on the OLED panel 200, lines 701, 702, and 703 do not intersect, the unbroken line 701 is lowest and the dot-dash line 703 is highest. Accordingly, as ambient temperature rises, light collection efficiency monotonically increases, and therefore as the detected light amount P0 detected by the light receiving element 603 increases, ambient temperature increases, and expansion of the rod-lens array 202 becomes significant.

Figure 8A:
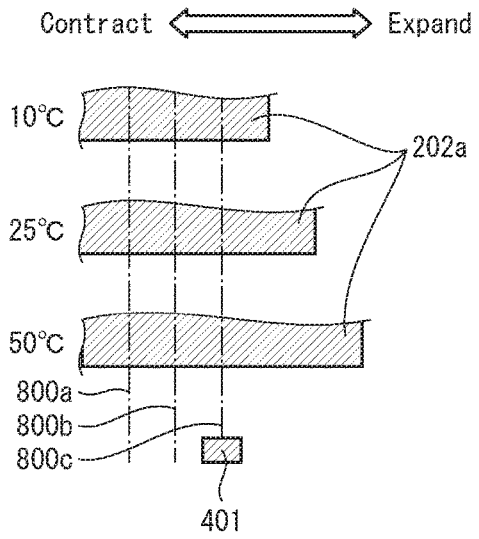
FIG. 8A shows expansion and contraction of rod-lens array 202 and change in light collection efficiency when detection OLED 401 is in position range 711.
Figure 8C:
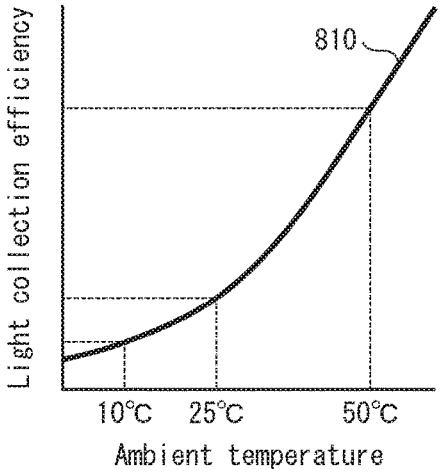
FIG. 8C is a graph showing temperature property of light collection efficiency when detection OLED 401 is in position range 711.

As shown in FIG. 8A, when ambient temperature is low (for example, 10 degrees Celsius), a position of the rod-lens array 202 opposite the detection OLED 401 is removed from an optical axis 800*a* of one rod lens 202*a* of the rod-lens array 202; as ambient temperature increases, for example from 25 degrees Celsius to 50 degrees Celsius, the position opposite the detection OLED 401 becomes closer to an optical axis 800*b* and an optical axis 800*c*, in this order. In this case, as shown by a line 810 in FIG. 8C, as ambient temperature increases, light collection efficiency monotonically increases and the detected light amount P0 detected by the light receiving element 603 also monotonically increases. Accordingly, in the range of operating environment temperature of the image forming device 1 and the optical print head 100, linear expansion difference between the OLED panel 200 and the rod-lens array 202 is a monotonically increasing function of ambient temperature.

In a case in which the detection OLED 401 is disposed in a range 712 on the OLED panel 200, the lines 701, 702, and 703 do not intersect, the unbroken line 701 is highest and the dot-dash line 703 is lowest. Accordingly, as ambient temperature rises, light collection efficiency monotonically decreases, and therefore as the detected light amount P0 detected by the light receiving element 603 decreases, ambient temperature increases, and expansion of the rod-lens array 202 becomes significant.

Figure 8B:
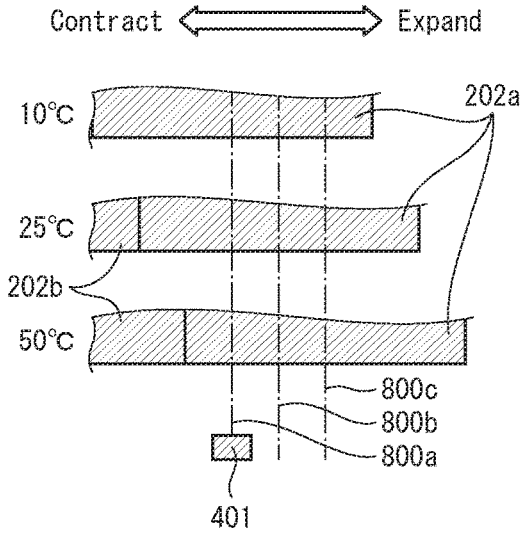
FIG. 8B shows expansion and contraction of rod-lens array 202 and change in light collection efficiency when detection OLED 401 is in position range 712.
Figure 8D:
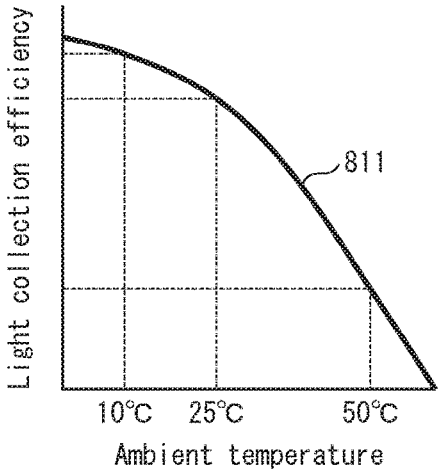
FIG. 8D is a graph showing temperature property of light collection efficiency when detection OLED 401 is in position range 712.

As shown in FIG. 8B, when ambient temperature is low, a position of the rod-lens array 202 opposite the detection OLED 401 is near the optical axis 800*a* of the rod lens 202*a* of the rod-lens array 202; as ambient temperature increases, the position opposite the detection OLED 401 becomes further from the optical axis 800*c*. In this case, as shown by a line 811 in FIG. 8D, as ambient temperature increases, light collection efficiency monotonically decreases and the detected light amount P0 detected by the light receiving element 603 also monotonically decreases. Accordingly, in the range of operating environment temperature of the image forming device 1 and the optical print head 100, linear expansion difference between the OLED panel 200 and the rod-lens array 202 is a monotonically decreasing function of ambient temperature.

On the other hand, in FIG. 7, when the detection OLED 401 is disposed at a position where elevations of the lines 701, 702, and 703 are not in ambient temperature order, light collection efficiency does not change monotonically and the detected light amount P0 detected by the light receiving element 603 does not change monotonically. Accordingly, ambient temperature and the detected light amount P0 do not have a one-to-one correspondence, and therefore it is difficult to uniquely determine linear expansion difference according to ambient temperature from the detected light amount P0. Thus, it is desirable that the detection OLED 401 is disposed at a position where the detected light amount P0 detected by the light receiving element 603 changes monotonically according to ambient temperature, in a temperature range in which normal operation of the optical print head 100 is guaranteed.

The detection OLED 401 is mounted on the same OLED panel 200 as the exposure OLEDs 201. Thus, the amount of incident light detected by the light receiving element 603 reflects the positions of the exposure OLEDs 201 and rod lenses relative to each other, and therefore positions of the exposure OLEDs 201 and rod lenses relative to each other can be detected from the detected light amount P0 detected by the light receiving element 603. The detected light amount P0 is therefore an index value of linear expansion difference.

(1-4) Light Amount Correction

The following describes light amount correction of the exposure OLEDs 201.

Figure 9:
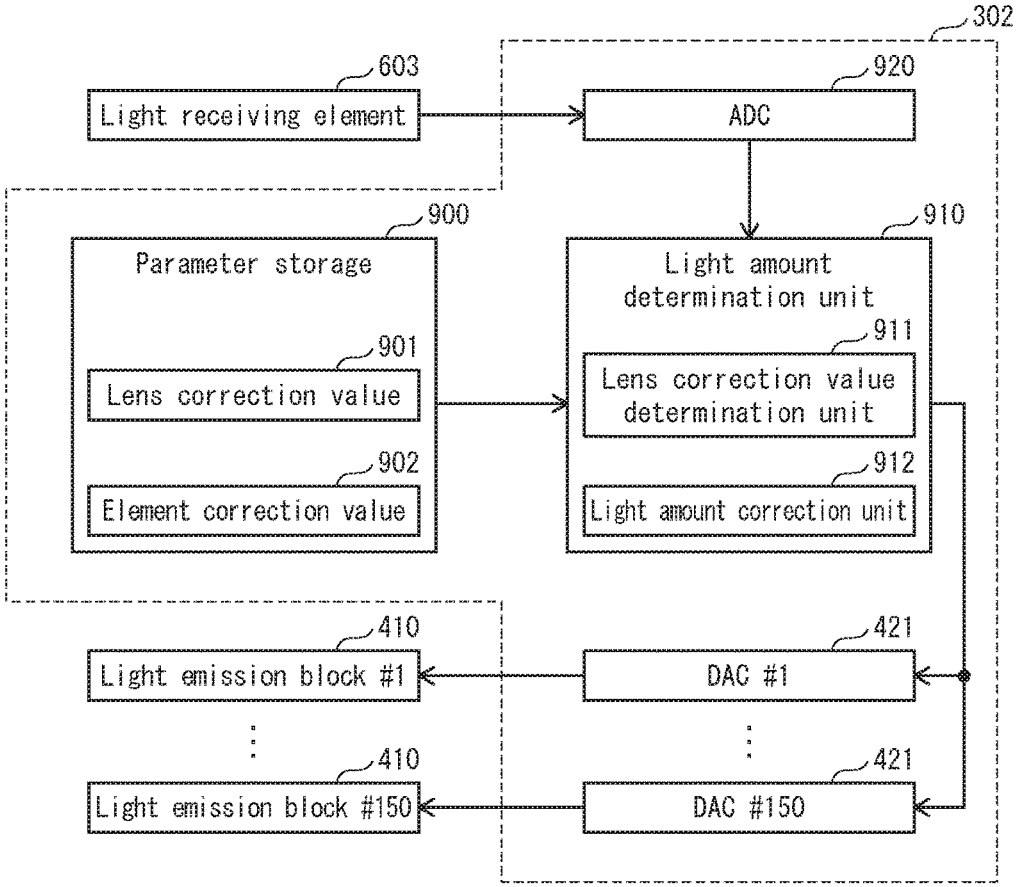
FIG. 9 is a block diagram showing a function configuration for correcting unevenness in light amount due to position shift between exposure OLEDs 201 and rod-lens array 202.

When image data received from the controller 102 is DA converted to generate a DAC signal, the optical print head 100 performs light amount correction by correcting the DAC signal according to positions of the exposure OLEDs 201 relative to each other. FIG. 9 is a block diagram showing functions for correcting a DAC signal.

As shown in FIG. 9, the optical print head 100 stores in advance a lens correction value 901 and an element correction value 902 in a parameter storage 900. The lens correction value 901 is a parameter for correcting light amount variance caused by variance in positions of the exposure OLEDs 201 and the rod lenses relative to each other. The lens correction value 901 can be determined in advance by actual measurement prior to factory shipment of the image forming device 1.

As illustrated in FIG. 10A, a lens correction value table 1000 is a table that stores a lens correction value 901 corresponding to a detected light amount, for each of the exposure OLEDs 201 from element numbers 1 to 15,000 and for detected light amounts Pa to Pz detected by the light receiving element 603. According to the present embodiment, the detected light amounts Pa to Pz are all digital values.

The element correction value 902 is a parameter for correction light amount variance caused by degradation, temperature, and the like of the exposure OLEDs 201. As illustrated in FIG. 10B, the element correction value table 1010 stores an element correction value for each combination of light amount, cumulative light emission time, and ambient temperature of the exposure OLEDs 201. Ambient temperature of the exposure OLEDs 201 is detected by a temperature sensor 310 included in the source IC 302.

As an alternative to temperature detected by the temperature sensor 310, internal temperature may be detected at the optical print head 100 or a position other than the optical print head 100 of the image forming device 1. Cumulative light emission time of each of the exposure OLEDs 201 may be measured by counting the number of times of light emission by referencing image data received from the controller 102, for example.

A light amount determination unit 910 includes a lens correction value determination unit 911 and a light amount correction unit 912. The lens correction value determination unit 911 acquires a value obtained by digitizing an output signal of the light receiving element 603 via an analogue to digital converter (ADC) 920 as the detected light amount P0 of the light receiving element 603, references the lens correction value table 1000, and when the detected light amount P0 matches any one of the detected light amounts Pa to Pz, determines the lens correction value corresponding to the detected light amount P0. When the detected light amount P0 does not match any of the detected light amounts Pa to Pz, the lens correction value can be determined by using linear interpolation, as described later.

The light amount correction unit 912 references the element correction value table 1010 to read the element correction value 902 corresponding to a combination of past light amount, cumulative light emission time, and ambient temperature of the exposure OLEDs 201. Then, using the lens correction value 901 determined by the lens correction value determination unit 911 and the element correction unit 902, the light amount correction unit 912 performs light amount correction by correcting DAC values as in Math 1.

[Math 1]

$$\text{(Post-correction DAC value)}=\text{(initial DAC value)}\times\text{(lens correction value)}\times\text{(element correction value)} \quad (1)$$

The initial DAC value is a DAC value for causing each of the exposure OLEDs 201 to emit a target light amount prior to any degradation over time at a predefined ambient temperature, which is stored in advance for each target light amount in the source IC 302. For example, the target light amount varies depending on system speed of the image forming device, and system speed becomes slower when thicker paper than normal is used as a recording sheet. Therefore, when thick paper is used, the target light amount is reduced compared with a case in which regular paper is used.

The light amount determination unit 910 inputs the DAC value after correction to the exposure DACs 421, causing DAC signals to be inputted to the light emission blocks 421 corresponding to the exposure DACs 421. By measuring position shift and determining correction value, it is possible to accurately correct light amount unevenness at a time of change in relative positions.

Electronically erasable programmable read only memory (EEPROM) can be used as the parameter storage 900. In FIG. 9, the parameter storage 900 is included in the source IC 302, but the parameter storage 900 may be external to the source IC 302.

[2] Embodiment 2

The following describes Embodiment 2 of the present invention.

An image forming device pertaining to the present embodiment has substantially the same configuration as the image forming device pertaining to Embodiment 1, but is different in structure holding the light receiving element 603. The following description focuses on differences. In the present description, member that common to different embodiments are assigned common reference signs.

Figure 11:
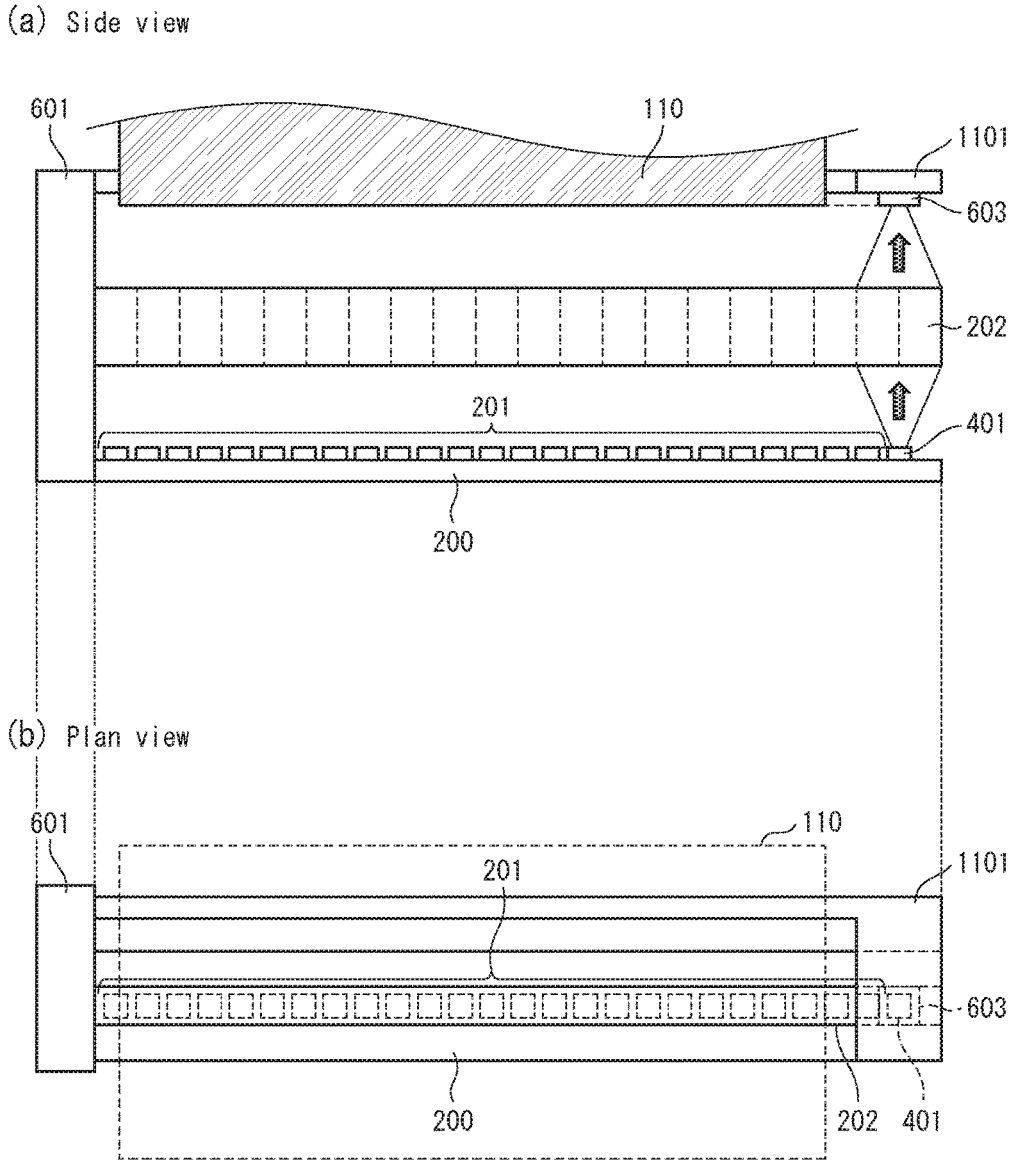
FIG. 11 shows a configuration for detecting position shift between exposure OLEDs 201 and rod-lens array 202 pertaining to Embodiment 2, part (a) showing a side view and part (b) showing a plan view.

According to the optical print head 100 pertaining to the present embodiment, as shown in FIG. 11, one end of a sensor support member 1101 that holds the light receiving element 603 is fixed to the support member 601, and the light receiving element 603 is fixed to the other end of the sensor support member 1101. Thus, in the longitudinal direction of the OLED panel 200, a distance from the fixed end to the detection OLED 401 is equal to a distance from the fixed end to the light receiving element 603.

Further, the sensor support member 1101 is made from the same material as the glass plate structure of the OLED panel 200, and therefore expansion and contraction of the sensor support member 1101 due to ambient temperature changes is the same as expansion and contraction of the OLED panel 200. With such a configuration, positions of the detection OLED 401 and the light receiving element 603 relative to each other are kept constant regardless of ambient temperature.

According to this configuration, changes in position of rod lens and exposure OLEDs 201 relative to each other that are caused by expansion and contraction of the rod-lens array 202 due to changes in ambient temperature can be accurately detected as changes in the detected light amount P0 detected by the light receiving element 603. Accordingly, unevenness in light amount caused by changes in ambient temperature can be more accurately corrected.

The sensor holding member 1101 is an L shape in plan view (see FIG. 11, part (b)), in order that light emitted by the exposure OLEDs 201 is not blocked from the rod-lens array 202 to the outer circumferential surface of the photoreceptor drum 110.

Further, as long as a material that has the same linear expansion coefficient as the glass plate of the OLED panel 200 is used, a material other than the glass material may be used for the sensor support member 1101.

[3] Embodiment 3

The following describes Embodiment 3 of the present invention.

In consideration of temperature properties of the detection OLED 401 and the light receiving element 603, an image forming device of the present invention is characterized in that deterioration of detection accuracy caused by changes in ambient temperature is prevented.

Figure 12:
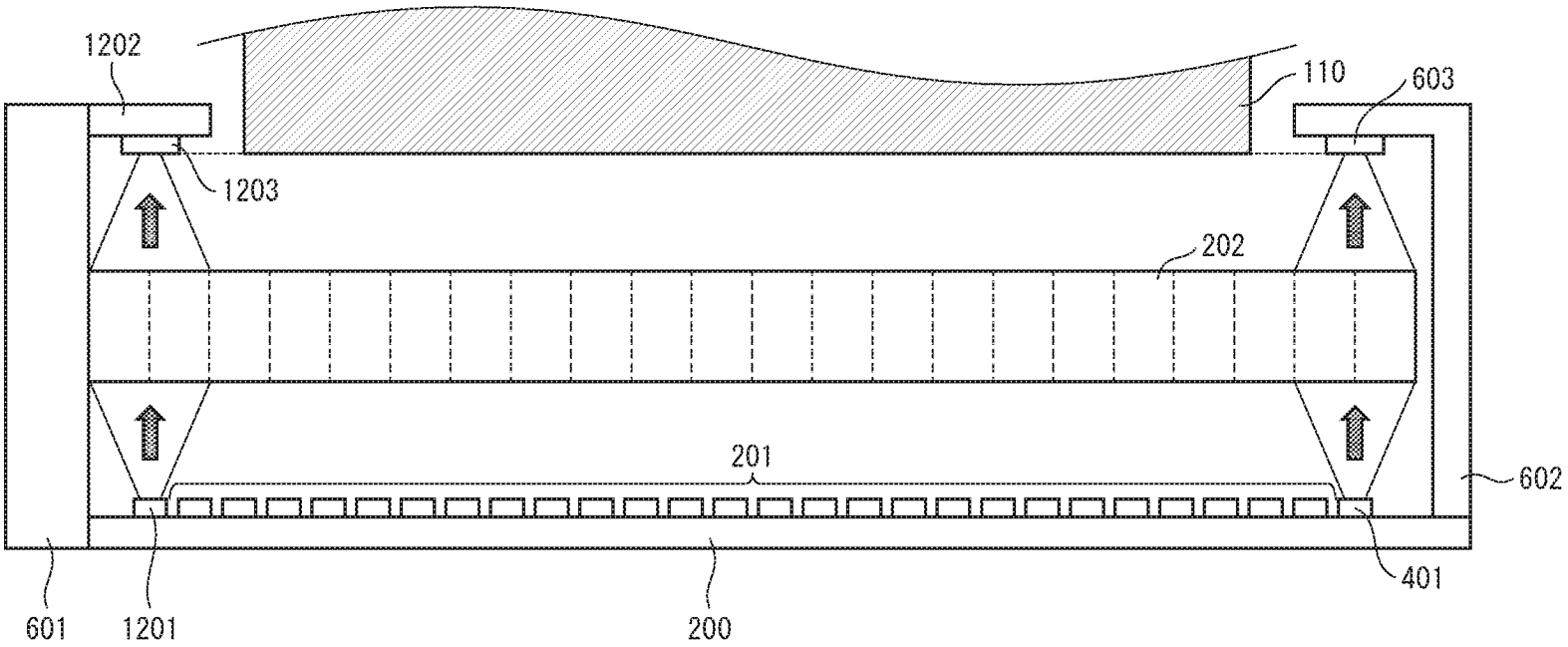
FIG. 12 shows a configuration for detecting position shift between exposure OLEDs 201 and rod-lens array 202 pertaining to Embodiment 3.

The optical print head 100 pertaining to the present embodiment includes a detection OLED 1201 next to an end of the exposure OLEDs 201 nearest the fixed end, in addition to the structure pertaining to Embodiment 1, as shown in FIG. 12. Light emitted by the detection OLED 1201 is collected by the rod-lens array 202 and incident on a light receiving element 1203. The light receiving element 1203 is held by a sensor support member 1202 fixed to the support member 601.

The detection OLED 1201 and the light receiving element 1203 are disposed closest to the fixed end, and therefore distance from the fixed end to the detection OLED 1201 and the light receiving element 1203 hardly changes even if ambient temperature changes. Thus, when ambient temperature changes, a detected light amount P1 detected by the light receiving element 1203 varies only due to temperature properties of the detection OLED 1201 and the light receiving element 1203.

Accordingly, by dividing the detected light amount P0 of the light receiving element 603 by the detected light amount P1 of the light receiving element 1203, variation of the detected light amount P0 due to temperature properties of the detection OLED 401 and the light receiving element 603 can be eliminated. That is, the detected light amount P0 of the light receiving element 603 is influenced by position shift:

[Math 2]

$$(\text{detected light amount } P0)=(\text{default light amount})\times(\text{position shift amount})\times(\text{temperature properties amount}) \quad (2)$$

in contrast, the detected light amount P1 of the light receiving element 1203 is not influenced by position shift:

[Math 3]

$$(\text{detected light amount } P1)=(\text{default light amount})\times(\text{temperature properties amount}) \quad (3)$$

and therefore the following division can calculate variation of the detected light amount P0 that is only due to position shift:

[Math 4]

$$(\text{position shift})=(\text{detected light amount } P0)/(\text{detected light amount } P1) \quad (4)$$

Figure 13:
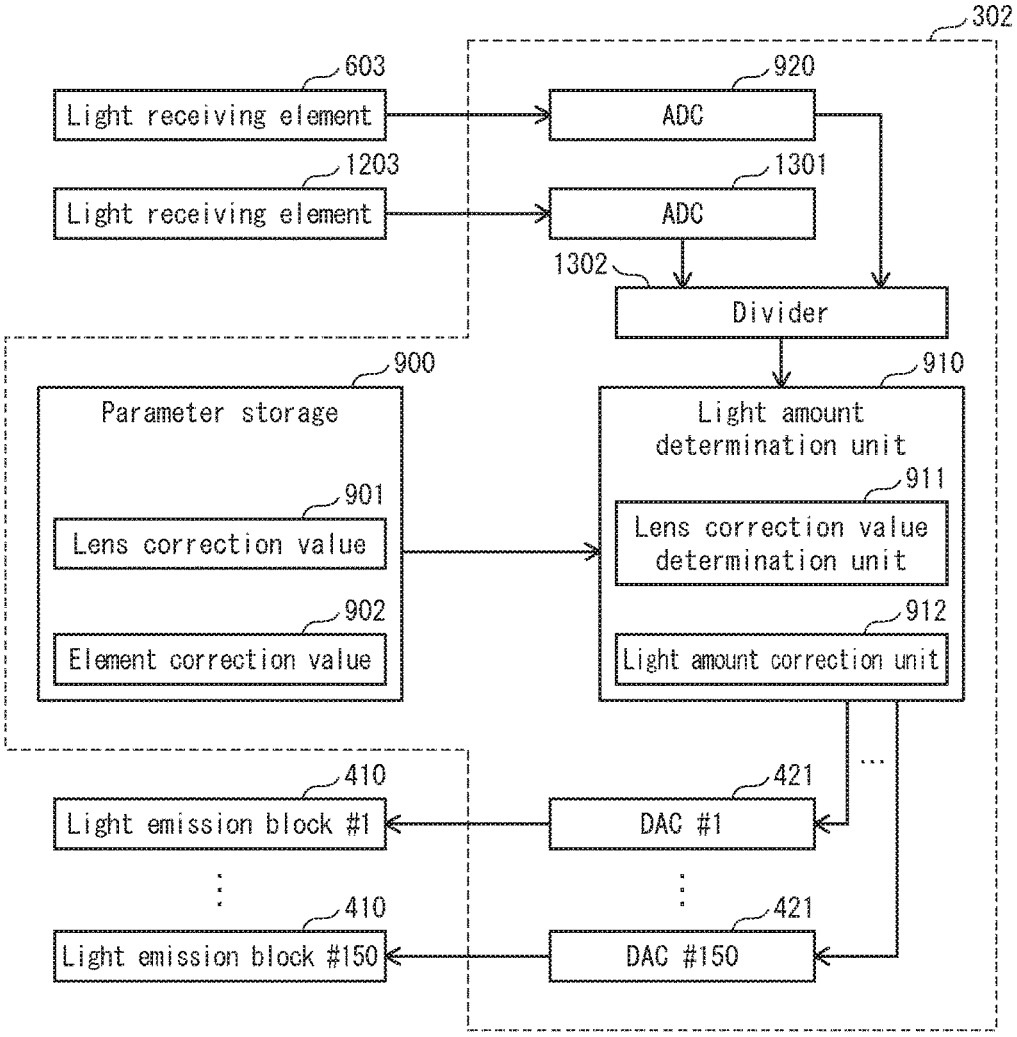
FIG. 13 is a block diagram showing a function configuration for correcting unevenness in light amount due to position shift between exposure OLEDs 201 and rod-lens array 202.

As shown in FIG. 13, detected light amounts of the light receiving elements 603 and 1203 are each digitized at ADCs 920 and 1301, respectively, and the detected light amount of the light receiving element 603 is divided by the detected light amount of the light receiving element 1203 at the divider 1302. Upon obtaining a division value from the divider 1302, the light quantity determination unit 910 refers to the parameter storage 900 and determines the lens correction value 901 according to the division value.

In determining the lens correction value 901, according to the lens correction value table 1000 pertaining to Embodiment 1, the lens correction value 901 is stored for each combination of detected light amount and element number of the exposure OLEDs 201. In contrast, according to a lens correction value table pertaining to the present embodiment, the lens correction value 901 is stored for each combination of division value instead of detected light amount and element number of the exposure OLEDs 201. The lens correction value 901 is determined by referencing such a lens correction value table.

Further, the element correction value 902 is acquired as per Embodiment 1, and light amount correction is performed. In this way, influence of ambient temperature on temperature properties of the detection OLED 401 and the light receiving element 603 can be eliminated, and therefore light amount unevenness can be corrected more accurately.

[4] Modifications

Above, the present invention is described based on embodiments, but the present invention is of course not limited to the embodiments above, and the following modifications of the present invention may be implemented.

(4-1) According to the embodiments above, an example is described in which the lens correction value 901 is stored in the lens correction value table 1000 for each combination of element number of the exposure OLEDs 201 and detected light amount, but the present invention is of course not limited to this example, and one alternative is described below.

For example, a light determination unit specifies a position of the detection OLED 401 (distance from the fixed end in the longitudinal direction) from the detected light amount P0 of the light receiving element 603, and when, with respect to a default position T0 of the detection OLED 401 (for example, position at an ambient temperature of 25 degrees Celsius), a current position is Ta, a position shift amount of the detection OLED 401 is (Ta−T0).

According to the position shift amount (Ta−T0) of the detection OLED 401, where default position of the exposure OLEDs 201 is Tb, position shift amount of the exposure OLEDs 201 is:

[Math 5]

$$Tb\times(Ta-T0)/T0 \tag{5}$$

When seeking a lens correction value, a lens correction value at a position shifted from the default position Tb by the position shift amount Tb×(Ta−T0)/T0 may be used. In this way it is possible to suppress unevenness in light amount caused by position shift between the rod-lens array 202 and the exposure OLEDs 201 due to changes in ambient temperature.

(4-2) According to the embodiments above, an example of calculating variance in detected light amount P0 caused only by position shift using Math 2, 3, and 4 is described, but the present invention is of course not limited to this example, and one alternative is described below.

For example, when the product rl×rt of light amount change rate rl caused by position shift between the rod-lens array 202 and the detection OLED 401 and light amount change rate rt caused by temperature properties of the detection OLED 401 and light receiving element 603 is a negligibly small value, Math 2 can be approximated as:

[Math 6]

$$\begin{aligned}(\text{Detected light amount } P0) &= \\ &(\text{default light amount})\times(1+r1)\times(1+rt)= \\ &(\text{default light amount})\times(1+r1+rt+(r1\times rt))\approx \\ &(\text{default light amount})\times(1+r1+rt)= \\ &(\text{default light amount})\times(1+rt)+(\text{default light amount})\times r1\end{aligned} \tag{6}$$

From Math 3:

[Math 7]

$$(\text{detected light amount } P1)=(\text{default light amount})\times(1+rt) \tag{7}$$

Thus, when detected light amount P0 is divided by detected light amount P1, a change amount of the detected light amount P0 caused only by position shift can be obtained.

[Math 8]

$$(\text{default light amount})\times rl=(\text{detected light amount } P0)-(\text{detected light amount } P1) \tag{8}$$

The lens correction value determination unit 911 can correct the light amount unevenness with sufficient accuracy even if the lens correction value is determined by using the value obtained in Math 8.

(4-3) According to the embodiments above, an example of seeking post-correction DAC value using Math 1 is described, but the present invention is of course not limited to this example, and one alternative is described below. For example, when the lens correction value 901 and the element correction value 902 are respectively:

[Math 9]

$$(\text{lens correction value})=1+(\text{lens correction rate}) \tag{9}$$

[Math 10]

$$(\text{element correction value})=1+(\text{element correction rate}) \tag{10}$$

When the product of the lens correction rate and the element correction rate is sufficiently small to be negligible, Math 1 can be approximated as follows:

[Math 11]

$$\begin{aligned}&(\text{Post-correction DAC value})=(\text{initial DAC value})\times \\ &\{1+(\text{lens correction rate})\}\times\{1+(\text{element correction rate})\}=(\text{initial DAC value})\times\{1+(\text{lens correction rate})+(\text{element correction rate})+((\text{lens correction rate})\times(\text{element correction rate}))\}\approx \\ &(\text{initial DAC value})\times\{1+(\text{lens correction rate})+(\text{element correction rate})\}\end{aligned} \tag{11}$$

Accordingly, even if Math 11 is used, light amount unevenness can be corrected with sufficient accuracy.

(4-4) Although not mentioned specifically for the embodiments above, light amount variation caused by deterioration, temperature properties, and the like, may be corrected for the detection OLED 401 and the detection OLED 1201.

Whether for exposure or detection, an OLED has in principle a light amount deterioration property of light amount decreasing as cumulative light emission time increases, and a light amount variation property of light amount varying as ambient temperature varies.

According to this modification, in order to prevent light amount variation of the detection OLED 401, an element correction value table for the detection OLED 401 is prepared and an element correction value stored for each combination of cumulative light emission time of the detection OLED 401 and ambient temperature. Unlike the exposure OLEDs 201, the detection OLED 401 is not required to switch light amounts, and therefore an element correction value table for each light amount is not required.

The optical print head 100 references detected temperature of the temperature sensor 310 in the source IC 302, acquires ambient temperature of the detection OLED 401, and counts the number of times of light emission by the detection OLED 401 as the cumulative light emission time. The element correction table is referred to from the ambient temperature and the cumulative light emission time thus specified, an element correction value is acquired, and DAC value is corrected as shown in Math 12:

[Math 12]

$$(\text{post-correction DAC value})=(\text{initial DAC value})\times(\text{element correction value}) \tag{12}$$

When the post-correction DAC value is inputted to the detection DAC 420, light amount correction of the detection OLED 401 is performed. In this way, it is possible to prevent light amount variation due to deterioration and temperature properties of the detection OLED 401 and the detection OLED 1201, and therefore it is possible to accurately detect position shift between the exposure OLEDs 201 and the rod-lens array 202.

(4-5) According to the embodiments above, the exposure OLEDs 201 are arranged along a longitudinal direction, but the exposure OLEDs 201 may be arranged in a straight line or in a staggered arrangement. In any arrangement the effects of the present invention are the same.

(4-6) According to the embodiments above, examples are described in which a fixed position at which the OLED panel 200 is fixed to the support member 601 and a fixed position at which the rod-lens array 202 is fixed to the support member 601 match up in the longitudinal direction, but the present invention is of course not limited to this example and one alternative is described below.

For example, a step may be provided on a fixing side of the support member 601, and the fixed position of the OLED panel 200 and the fixed position of the rod-lens array 202 may be different from each other in the longitudinal direction. Provision of such a step makes it possible to adjust positions of the OLED panel 200 and the rod-lens array 202 relative to each other to ensure that detected light amount detected by the light receiving element 603 monotonically increases or decreases in accordance with an increase in ambient temperature.

(4-7) Although not mentioned specifically in the embodiments above, the lens correction value table 1000 can be prepared as described below.

First, prior to factory shipment of the image forming device 1, under each environmental condition where the detected light amount of the light receiving element 603 is Pa, one of the exposure OLEDs 201 that has an element number #1 is caused to emit light amount La, the emitted light is collected by the rod-lens array 202, and a light amount p0 is measured at a position corresponding to the outer circumferential surface of the photoreceptor drum 110.

Subsequently, a ratio between a target light amount p1 to be incident on the outer circumferential surface of the photoreceptor drum 110 and the measured light amount p0 under the above conditions is obtained, and a lens correction value LCa1 is determined from drive current-light emission amount properties of the one of the exposure OLEDs 201. If the measured light amount p0 is smaller than the target light amount p1, the lens correction value LCa1 is determined so that the drive current amount is increased according to the drive current-light emission amount properties of the one of the exposure OLEDs 201, so that an amount of incident light on the outer circumferential surface of the photoreceptor drum 110 becomes the target light amount p1. Similarly, if the measured light amount p0 is larger than the target light amount p1, the lens correction value LCa1 is determined so that the drive current amount is decreased. Lens correction values related to other combinations of detected light amounts and element numbers can be similarly determined.

In this way, light emitted by the OLEDs 201 is corrected so as to offset change in light collection efficiency caused by position shift between the OLEDs 201 and the rod-lens array 202, and therefore changes in light amount received on the outer circumferential surface of the photoreceptor drum 110 can be suppressed.

When the lens correction value table 1000 does not include a detected light amount that matches the detected light amount detected by the light receiving element 603, the lens correction value may be determined by using linear interpolation. For example, if a detected light amount p is between Pa and Pb, the lens correction value for element number #1 of the exposure OLEDs 201 can be determined as in Math 13:

[Math 13]

$$(\text{lens correction value})=\{LCa1\times(Pb-p)+LCb1\times(p-Pa)\}/(Pb-Pa) \quad (13)$$

In this way, a lens correction value appropriate for the detected light amount p can be determined.

(4-8) According to the embodiments above, an example is described of preventing light amount unevenness due to position shift between the OLED panel 200 and the rod-lens array 202 caused by operating environment conditions of the image forming device 1 such as temperature and humidity. However, for example, it is also expected that the resin used for integrating the rod lenses of the rod-lens array 202 will contract due to aging, causing a position shift between the exposure OLEDs 201 and the rod lenses. In such a case, a plurality of the lens correction value table 1000 may be prepared according to length of use of the optical print head 100, and the appropriate one of the lens correction value table 1000 may be used according to the length of use.

(4-9) According to the embodiments above, an example is described of the sensor holding member 602 being fixed to the non-fixed end of the OLED panel 200, but the present invention is of course not limited to this example, and one alternative is described below. The glass plate of the OLED panel 200 has a very small linear expansion coefficient and hardly expands or contracts even when ambient temperature changes. Thus, even if the sensor holding member 602 is fixed to the OLED panel 200 at a position other than the non-fixed end, position shift between the exposure OLEDs 201 and the rod-lens array 202 can be accurately detected.

(4-10) According to the embodiments above, the operating environment conditions of the image forming device 1 and the optical print head 100 are described as being set to a range from 10 degrees Celsius to 35 degrees Celsius for temperature and from 15% to 85% for humidity. However, the present invention is of course not limited to this example, and the operating environment conditions may be set to other ranges for temperature and humidity.

It is preferable that the linear expansion difference between the OLED panel 200 and the rod-lens array 202 is a monotonous function not only in the operating environment temperature range of the image forming device 1 and the optical print head 100, but also in the operating environment humidity range. Thus, even when the linear expansion difference changes due to a change in ambient humidity, it is possible to correct light amount unevenness with high accuracy.

(4-11) According to the embodiments above, an example is described in which the image forming device 1 is a tandem-type color printer device, but the present invention is of course not limited to this example, and alternatives include a color printer devices and monochrome printer devices that are not tandem types. Further, effects of the present invention can be achieved when the present invention is applied to a copying device incorporating a scanner, a facsimile device incorporating a communication function, or a multi-function peripheral (MFP) incorporating several such functions.

[5] Summary

As long as an optical print head comprises: a light emitting member elongated in a longitudinal direction with light emitting elements arranged along the longitudinal direction; an optical member elongated in the longitudinal direction with optical elements arranged along the longitudinal direction, the optical elements collecting light emitted by the light emitting elements; a detection unit that detects an index value of linear expansion difference in the longitudinal direction of the light emitting member and the optical member; and a correction unit that uses the index value to correct an emitted light amount for each of the light emitting elements in order to offset differences in light collection efficiency caused by the linear expansion difference, emitted light amounts are corrected for each of the light emitting elements in order to offset differences in light collection efficiency caused by linear expansion difference between the light emitting member and the optical member, and therefore light amount unevenness caused by changes in ambient conditions can be accurately corrected.

The optical print head may further comprise a fixing member to which both the light emitting member and the optical member are fixed, a point where the fixing member and the light emitting member are fixed to each other being referred to as a fixed position, wherein the detection unit detects the index value at a position different from the fixed position in the longitudinal direction.

The optical print head may be configured such that one end of the light emitting member in the longitudinal direction and one end of the optical member in the longitudinal direction are fixed to the fixing member, and a position of detection of the index value is a detection position near an opposite end to the fixed position in the longitudinal direction and outside a range of light emitting elements used in optical writing among the light emitting elements.

The optical print head may further comprise: a support member that supports the detection unit, wherein the light emitting member has a substrate on which the light emitting elements are mounted, and the support member is fixed to the substrate.

The optical print head may further comprise: a support member that supports the detection unit, wherein the light emitting member has a substrate on which the light emitting elements are mounted, the support member is an elongated member made from a material that has the same linear expansion coefficient as the substrate, and one end of the support member in the longitudinal direction is fixed to the fixing member, and the support member is arranged parallel to the light emitting member.

The optical print head may be configured such that the detection unit further comprises: a detection light receiving element that receives light via the optical member that is emitted from one of the light emitting elements, wherein the detection light receiving element is disposed at the detection position, and the index value is a received light amount received by the detection light receiving element.

The optical print head may be configured such that the fixing member is fixed to the light emitting member and the optical member so that, in a predefined range of operating environment conditions, the index value is a monotonically increasing function or a monotonically decreasing function of the linear expansion difference between the light emitting member and the optical member.

The optical print head may be configured such that the detection position is disposed so that, in a predefined range of operating environment conditions, the index value is a monotonically increasing function or a monotonically decreasing function of the linear expansion difference between the light emitting member and the optical member.

The optical print head may be configured such that the detection unit further comprises: a reference light receiving element that receives light via the optical member that is emitted from a different one of the light emitting elements than the one of the light emitting elements, wherein the reference light receiving element is disposed nearer to the fixed position than the detection light receiving element in the longitudinal direction, and the detection unit corrects the index value by using a received light amount received by the reference light receiving element.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An optical print head comprising:

a light emitting member elongated in a longitudinal direction with light emitting elements arranged along the longitudinal direction;

an optical member elongated in the longitudinal direction with optical elements arranged along the longitudinal direction, the optical elements collecting light emitted by the light emitting elements;

a detection unit that detects an index value that is dependent on a linear expansion difference between a linear expansion of the light emitting member in the longitudinal direction and a linear expansion of the optical member in the longitudinal direction; and a correction unit that uses the index value to correct an emitted light amount for each of the light emitting elements in order to offset differences in light collection efficiency caused by the linear expansion difference.

2. The optical print head of claim 1, further comprising:

a fixing member to which both the light emitting member and the optical member are fixed, a point where the fixing member and the light emitting member are fixed to each other being referred to as a fixed position, wherein the detection unit detects the index value at a position different from the fixed position in the longitudinal direction.

3. The optical print head of claim 2, wherein one end of the light emitting member in the longitudinal direction and one end of the optical member in the longitudinal direction are fixed to the fixing member, and a position of detection of the index value is a detection position near an opposite end to the fixed position in the longitudinal direction and outside a range of light emitting elements used in optical writing among the light emitting elements.

4. The optical print head of claim 2, further comprising:

a support member that supports the detection unit, wherein the light emitting member has a substrate on which the light emitting elements are mounted, and the support member is fixed to the substrate.

5. The optical print head of claim 2, further comprising:

a support member that supports the detection unit, wherein the light emitting member has a substrate on which the light emitting elements are mounted, the support member is an elongated member made from a material that has the same linear expansion coefficient as the substrate, and one end of the support member in the longitudinal direction is fixed to the fixing member, and the support member is arranged parallel to the light emitting member.

6. The optical print head of claim 2, wherein the detection unit further comprises:

a detection light receiving element that receives light via the optical member that is emitted from one of the light emitting elements, wherein the detection light receiving element is disposed at the detection position, and the index value is a received light amount received by the detection light receiving element.

7. The optical print head of claim 6, wherein the detection unit further comprises:

a reference light receiving element that receives light via the optical member that is emitted from a different one of the light emitting elements than the one of the light emitting elements, wherein the reference light receiving element is disposed nearer to the fixed position than the detection light receiving element in the longitudinal direction, and the detection unit corrects the index value by using a received light amount received by the reference light receiving element.

8. The optical print head of claim 2, wherein the fixing member is fixed to the light emitting member and the optical member so that, in a predefined range of operating environment conditions, the index value is a monotonically increasing function or a monotonically decreasing function of the linear expansion difference between the light emitting member and the optical member.

9. The optical print head of claim 2, wherein the detection position is disposed so that, in a predefined range of operating environment conditions, the index value is a monotonically increasing function or a monotonically decreasing function of the linear expansion difference between the light emitting member and the optical member.

10. The optical print head of claim 9, wherein the detection unit further comprises:

a reference light receiving element that receives light via the optical member that is emitted from a different one of the light emitting elements than the one of the light emitting elements, wherein the reference light receiving element is disposed nearer to the fixed position than the detection light receiving element in the longitudinal direction, and the detection unit corrects the index value by using a received light amount received by the reference light receiving element.

11. The optical print head of claim 1, wherein there are positions in the optical print head at which the index value changes monotonically with a change in ambient temperature and there are other positions in the optical print head at which the index value does not change monotonically with the change in ambient temperature; and the detection unit is arranged at one of the positions in the optical print head relative to the optical member at which the index value monotonically increases as the ambient increases within a predetermined range of ambient temperatures or one of the positions in the optical print head relative to the optical member at which the index value monotonically decreases as the ambient temperature increases within the predetermined range of ambient temperatures.

12. An image forming device that has an optical print head that includes:

a light emitting member elongated in a longitudinal direction with light emitting elements arranged along the longitudinal direction; and an optical member elongated in the longitudinal direction with optical elements arranged along the longitudinal direction, the optical elements collecting light emitted by the light emitting elements, the image forming device comprising:

a detection unit that detects an index value that is dependent on a linear expansion difference between a linear expansion of the light emitting member in the longitudinal direction and a linear expansion of the optical member in the longitudinal direction; and a correction unit that uses the index value to correct an emitted light amount for each of the light emitting elements in order to offset differences in light collection efficiency caused by the linear expansion difference.

* * * * *